US009539827B2

(12) United States Patent
Sasaki et al.

(10) Patent No.: US 9,539,827 B2
(45) Date of Patent: Jan. 10, 2017

(54) TRANSPORTATION APPARATUS AND RECORDING APPARATUS

(71) Applicant: Seiko Epson Corporation, Tokyo (JP)

(72) Inventors: Tsuneyuki Sasaki, Matsumoto (JP); Junya Kato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/930,223

(22) Filed: Nov. 2, 2015

(65) Prior Publication Data

US 2016/0136977 A1 May 19, 2016

(30) Foreign Application Priority Data

Nov. 13, 2014 (JP) ..... 2014-230527

(51) Int. Cl.
*B41J 11/42* (2006.01)
*B65H 7/08* (2006.01)
*B65H 23/038* (2006.01)

(52) U.S. Cl.
CPC ..... *B41J 11/42* (2013.01); *B65H 7/08* (2013.01); *B65H 23/038* (2013.01); *B65H 2301/4493* (2013.01); *B65H 2404/143* (2013.01); *B65H 2553/30* (2013.01); *B65H 2553/40* (2013.01); *B65H 2553/414* (2013.01); *B65H 2601/272* (2013.01); *B65H 2801/12* (2013.01)

(58) Field of Classification Search
CPC ..... B41J 11/42; B65H 7/08; B65H 2553/30; B65H 2553/40
See application file for complete search history.

(56) References Cited

U.S. PATENT DOCUMENTS 5,589,858 A * 12/1996 Kadowaki ..... B41J 11/42 347/117
2005/0019075 A1 1/2005 Adachi et al.
2005/0263958 A1* 12/2005 Knierim ..... B65H 9/002 271/272
2007/0075483 A1 4/2007 Katayama
2009/0002424 A1* 1/2009 Kiyama ..... B41J 3/543 347/16

FOREIGN PATENT DOCUMENTS

JP 2003-146484 A 5/2003

* cited by examiner

*Primary Examiner* — Stephen Meier
*Assistant Examiner* — Alexander D Shenderov

(57) ABSTRACT

A transportation apparatus includes a first velocity sensor that detects a first measure of the transportation velocity of a medium that is transported, and a second velocity sensor that detects a second measure of the transportation velocity of the medium. The first and second velocity sensors are positioned offset from each other in an intersecting direction that intercepts a transportation direction of the medium. A skew detection section calculates a velocity difference from the first and second measures of the transportation velocities, and determines a skew state of the medium on the basis of the velocity difference.

12 Claims, 11 Drawing Sheets

TRANSPORTATION APPARATUS AND RECORDING APPARATUS

BACKGROUND

1. Technical Field

The present invention relates to a transportation apparatus and a recording apparatus.

2. Related Art

A transportation apparatus that transports a transportation target medium, for example, a recording apparatus (such as a printer) that has a transportation apparatus (such as a paper feeder/conveyer) that transports a recording target medium (such as paper to be printed upon) and performs recording (e.g., printing) thereon, is used in related art. In such a transportation apparatus, when a transportation target medium is transported in a skewed state (skewed transportation), it can cause various problems. To suppress the skewed transportation of a transportation target medium, techniques for detecting the skewed state of the transportation target medium have been proposed in the art. For example, a transportation apparatus that detects a leading edge of a transportation target medium and can detect skewed transportation on the basis of an inclination of the transportation target medium is disclosed in JP-A-2003-146484, wherein the inclination is calculated from the position of the leading edge.

However, since the transportation apparatus of JP-A-2003-146484 detects the leading edge of a transportation target medium to judge the inclination of the transportation target medium, it cannot be used in a roll-to-roll transportation structure, in which a continuous medium such as a roll-type recording target medium is transported. Therefore, transportation target media to which it can be applied are limited.

As described above, in a medium transportation apparatus of related art, it is difficult to detect the skewed state of a transportation target medium with high precision in some cases.

SUMMARY

An advantage of some aspects of the invention is to detect the skewed state of a transportation target medium with high precision.

The above advantage may be obtained in a transportation apparatus that includes: a first velocity sensor that detects transportation velocity of a medium that is transported; a second velocity sensor that detects transportation velocity of the medium and is provided at a position different from that of the first velocity sensor in an intersecting direction as viewed in a transportation direction of the medium, the intersecting direction intersecting with the transportation direction; and a skew detection section that calculates a velocity difference from the velocities detected by the first and second velocity sensors, and detects a skewed state of the medium on the basis of the velocity difference.

By this means, it is possible to detect the skewed state of the medium with high precision.

The above advantages may also be achieved in a transportation apparatus having: a first velocity sensor located at a first position to detect a first transportation velocity of a medium as it is transported in a transportation direction; a second velocity sensor to detect a second transportation velocity of the medium as it is transported in the transportation direction, the second velocity sensor being located at a second position offset from the first position in a spanning direction intersecting the transportation direction; and a skew detection section that calculates a velocity difference between the first transportation velocity and the second transportation velocity, and detects a skew state of the medium on the basis of the velocity difference.

Preferably, the first and second velocity sensors are each configured to emit a respective wave to the medium, to receive a resultant reflected wave from the medium, and calculate a transportation velocity of the medium from a frequency change due to a Doppler effect; and the wave is one of an electromagnetic wave or a sound wave.

The transportation apparatus may further include a skew correction execution section that executes skew correction for the medium on the basis of the skew state detected by the skew detection section.

In this case, the transportation apparatus may further include a transportation section that transports the medium intermittently, wherein the skew correction execution section executes the skew correction on the basis of a tendency of a change in the velocity difference when the medium is transported by the transportation section.

Preferably, the skew correction execution section calculates a cumulative value of the velocity difference each time new velocity difference is calculated, compares the cumulative value with a first threshold, and executes the skew correction if the magnitude of the cumulative value is in is not less than the magnitude of the first threshold.

The transportation apparatus may further include a transportation section that transports the medium intermittently, wherein: the skew detection section calculates a new one of the velocity difference each time the transportation section transports the medium; the skew detection section compares each new one of the velocity difference with a second threshold; and wherein error information is issued in response to a magnitude of a new one of the velocity difference exceeding a magnitude of the second threshold.

A transportation apparatus may further include a transportation section that transports the medium in a non-intermittent manner, wherein the skew correction execution section executes the skew correction on the basis of a tendency of a change in the velocity difference when the medium is transported non-intermittently by the transportation section.

Additionally, the skew correction execution section preferably calculates a cumulative value of the velocity difference when the medium is transported non-intermittently by the transportation section, compares the cumulative value with a third threshold, and executes the skew correction if the cumulative value is in excess of the third threshold.

Alternatively, the transportation apparatus may further include: a transportation section that transports the medium non-intermittently, wherein the velocity difference is compared with a fourth threshold when the medium is transported non-intermittently by the transportation section; and wherein error information is issued in response to the velocity difference being in excess of the fourth threshold.

The above advantages may also be obtained in a recording apparatus that includes any of the above embodiments of a preferred transportation apparatus, and additionally includes a recording section that records on the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, a recording apparatus that is an example of a transportation apparatus according to an exemplary embodiment of the present invention will now be explained in detail.

First Embodiment

Figure 1:
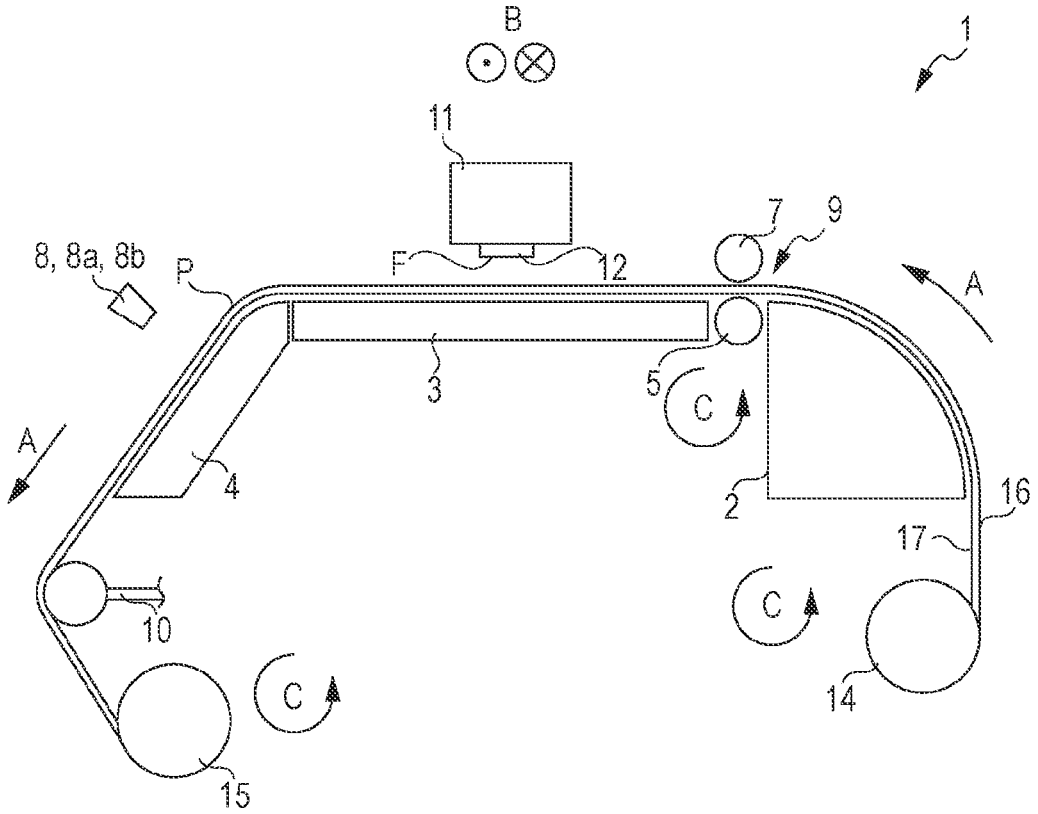
FIG. 1 is a schematic side view that illustrates a recording apparatus according to an embodiment of the invention.

FIG. 1 is a schematic side view that illustrates a recording apparatus 1 according to the present embodiment of the invention.

As illustrated in FIG. 1, the recording apparatus 1 of the present embodiment transports a recording target medium (transportation target medium) P in a transportation direction A from a set portion 14, on which the recording target medium P is set, to a reeling portion 15, which reels the recording target medium P, through platens 2, 3, and 4, which support the recording target medium P. That is, the transportation path of the recording target medium P leads from the set portion 14 to the reeling portion 15 in the recording apparatus 1. The platens 2, 3, and 4 constitute a recording target medium supporting portion provided along the transportation path. Preferably, the set portion 14 rotates in a rotation direction C to unreel the recording target medium P. Preferably, the reeling portion 15 rotates in the rotation direction C to reel the recording target medium P.

In the present embodiment, roll-type recording target medium P whose outer surface is a recording surface 16 is used. Therefore, when the recording target medium P is unreeled from the set portion 14, the rotary shaft of the set portion 14 rotates in the rotation direction C. If roll-type recording target medium P whose inner surface is the recording surface 16 is used, the recording target medium P can be unreeled from the set portion 14 by shaft rotation in the opposite direction and/or using a looping conveyance path that inverts the downward surface to face upwards. In like manner, in the present embodiment, the rotary shaft of the reeling portion 15 rotates in the rotation direction C because the reeling portion 15 reels the recording target medium P whose outer surface is the recording surface 16. The recording target medium P can be reeled onto the reeling portion 15 by shaft rotation in the opposite direction if the inner surface is the recording surface 16.

The recording apparatus 1 of the present embodiment is configured to be able to perform recording on roll-type recording target medium P. However, the configuration is not limited thereto. The recording apparatus 1 may be configured to be able to perform recording on sheet-type recording target medium P. When the recording apparatus 1 is configured to be able to perform recording on sheet-type recording target medium P, a so-called paper (feeder) tray or paper (feeder) cassette, etc. may be used as the set portion 14 for the recording target medium P. As an alternative receiver portion other than the reeling portion 15 for collecting the recording target medium P, for example, an ejection receiver, a so-called paper (ejector) tray or paper (ejector) cassette, etc. may be used. In a recording apparatus that can use either one or both of roll-type recording target medium P and sheet-type recording target medium P, a structure that does not include any collecting portion may be employed.

In the recording apparatus 1 of the present embodiment, a driving roller 5 is provided between the platens 2 and 3. The driving roller 5 has a rotary shaft extending in an intersecting direction B (i.e. into or out from the paper/medium on which FIG. 1 is drawn), which intersects with the transportation direction A. The driving roller 5 applies a feeding force to a reverse surface 17, which is the opposite of the recording surface 16 of the recording target medium P. A driven roller 7 is provided opposite the driving roller 5 on the transportation path of the recording target medium P. The driven roller 7 has a rotary shaft extending in the intersecting direction B. A pair of the driving roller 5 and the driven roller 7 can pinch the recording target medium P therebetween. The driving roller 5 and the driven roller 7 constitute a transportation unit 9. The term "driven roller" means a roller that performs follower rotation caused by the transportation of the recording target medium P. When the recording target medium P is transported in the transportation direction A, the driving roller 5 rotates in the rotation direction C, and the driven roller 7 rotates in the opposite direction.

The recording apparatus 1 of the present embodiment is equipped with a recording head 12 functioning as a recording unit. The recording head 12 and the platen 3 face each other. The recording apparatus 1 preferably records by ejecting ink from a nozzle-formed surface F of the recording head 12 while causing a carriage 11, on the bottom of which the recording head 12 is mounted, to reciprocate in the intersecting direction B, thereby forming an image as desired. With this structure, the recording head 12 can eject ink toward the recording target medium P.

Though the recording apparatus 1 of the present embodiment is equipped with the recording head 12, which performs recording while reciprocating, the recording apparatus 1 may be equipped with a so-called line head, in which plural nozzles for ink ejection are arranged in the direction B intersecting with the transportation direction A. The "line head" is a recording head that is used in a recording apparatus that forms an image by relative head-versusmedium movement wherein the area of nozzles formed in the direction B intersecting with the transportation direction A of the recording target medium P is formed in such a way as to cover the entirety of the recording target medium P in the intersecting direction B. The area of the nozzles formed in the intersecting direction B of the line head may be formed in such a way as not to cover the entirety of all of the recording target media P supported by the recording apparatus in the intersecting direction B. The recording head 12 of the present embodiment is a recording unit that can perform recording by ejecting ink in the form of liquid onto the recording target medium P. However, the recording unit is not limited to such a liquid ink ejection head. For example, a transfer-type recording unit that performs recording by transferring a coloring material onto the recording target medium P may be used.

A sensor 8, which is a velocity sensor that can detect the velocity of transportation of the recording target medium P, is provided at the downstream side of the transportation path of the recording target medium P as viewed from the recording head 12 in the transportation direction A at a position where it faces the platen 4. The sensor 8 will be described later in detail.

A tension bar 10 is provided on the transportation path of the recording target medium P between the sensor 8 and the reeling portion 15. The tension bar 10 is a tension-applying portion that ensures that the recording target medium P is tensioned along the transportation direction A. In the present embodiment, the attitude and position of the tension bar 10, the attitude and position of the set portion 14, and the attitude and position of the reeling portion 15 can be changed under the control of a control unit 18 (refer to FIG. 2). A directional adjustment of the recording target medium P in the intersecting direction B can be made by changing either one or both of the attitude and the position.

Figure 2:
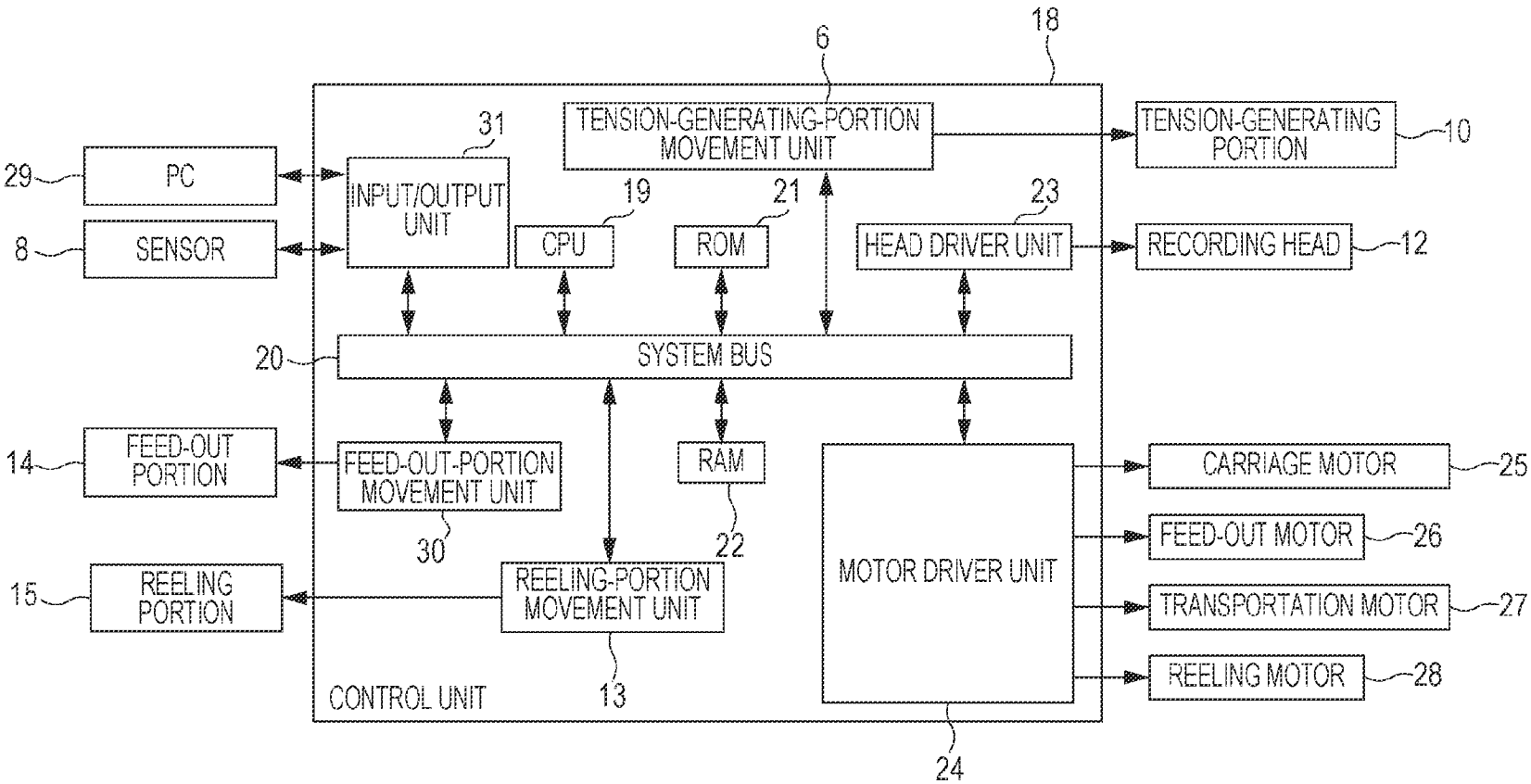
FIG. 2 is a block diagram that illustrates a recording apparatus according to an embodiment of the invention.

Next, the electric configuration of the recording apparatus 1 of the present embodiment will now be explained. FIG. 2 is a block diagram of the recording apparatus 1 of the present embodiment. A CPU 19, which controls the entire operation of the recording apparatus 1, is provided in the control unit 18. The CPU 19 is connected via a system bus 20 to a ROM 21, in which various control programs and maintenance sequences that are to be run by the CPU 19 are stored, and a RAM 22, into which data can be stored temporarily.

In addition, the CPU 19 is connected via the system bus 20 to a head driver unit 23, which drives the recording head 12. Moreover, the CPU 19 is connected via the system bus 20 to a motor driver unit 24, which drives a carriage motor 25, a feed-out motor 26, a transportation motor 27, and a reeling motor 28. The carriage motor 25 causes the carriage 11 to move. The feed-out motor 26 is the driving source of the feed-out portion 14. The transportation motor 27 is the driving source of the driving roller 5. The reeling motor 28 is the driving source of the reeling portion 15. In addition, the CPU 19 is connected via the system bus 20 to a tension-generating-portion movement unit 6 for changing the attitude and position of the tension-generating portion 10. Moreover, the CPU 19 is connected via the system bus 20 to a feed-out-portion movement unit 30 for changing the attitude and position of the feed-out portion 14. Furthermore, the CPU 19 is connected via the system bus 20 to a reeling-portion movement unit 13 for changing the attitude and position of the reeling portion 15. In addition, the CPU 19 is connected via the system bus 20 to an input/output unit 31. The input/output unit 31 is connected to the sensor 8, and a PC 29, which is an external apparatus that inputs recording data, etc. into the recording apparatus 1.

Figure 3:
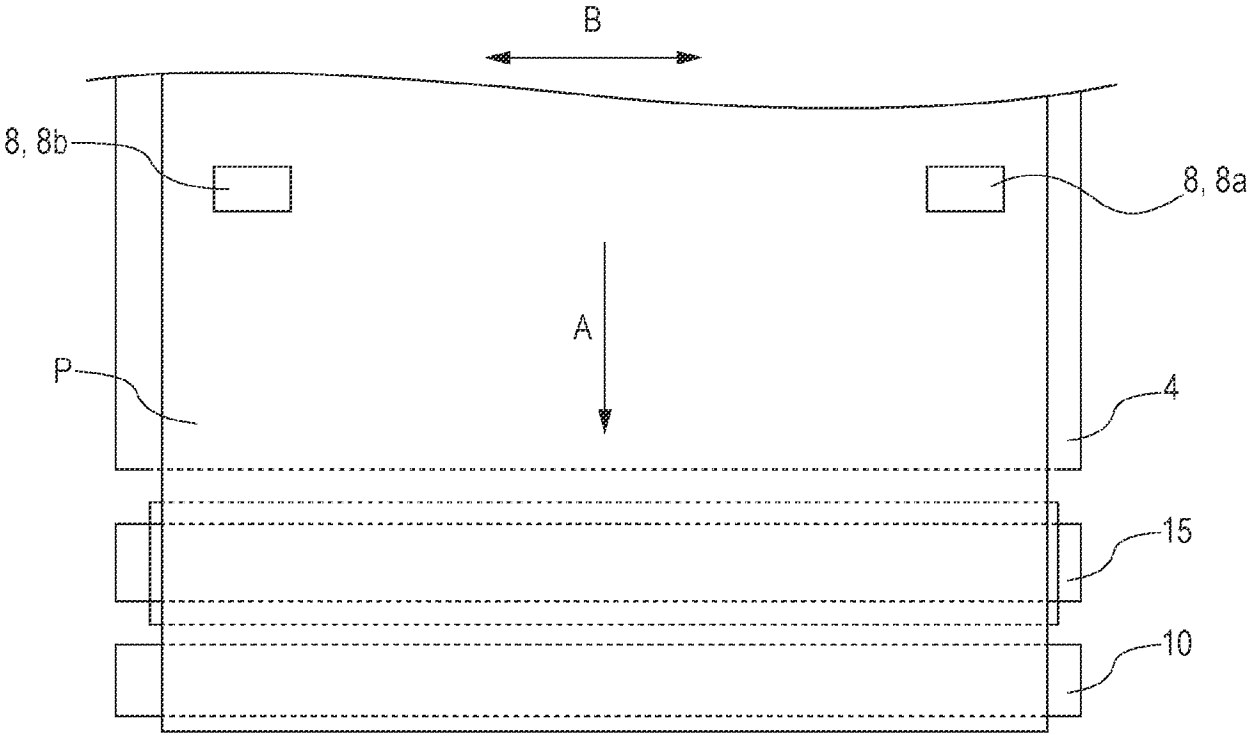
FIG. 3 is a schematic plan view that illustrates a recording apparatus in a straight transportation state, wherein a transportation target medium experience no skew.
Figure 4:
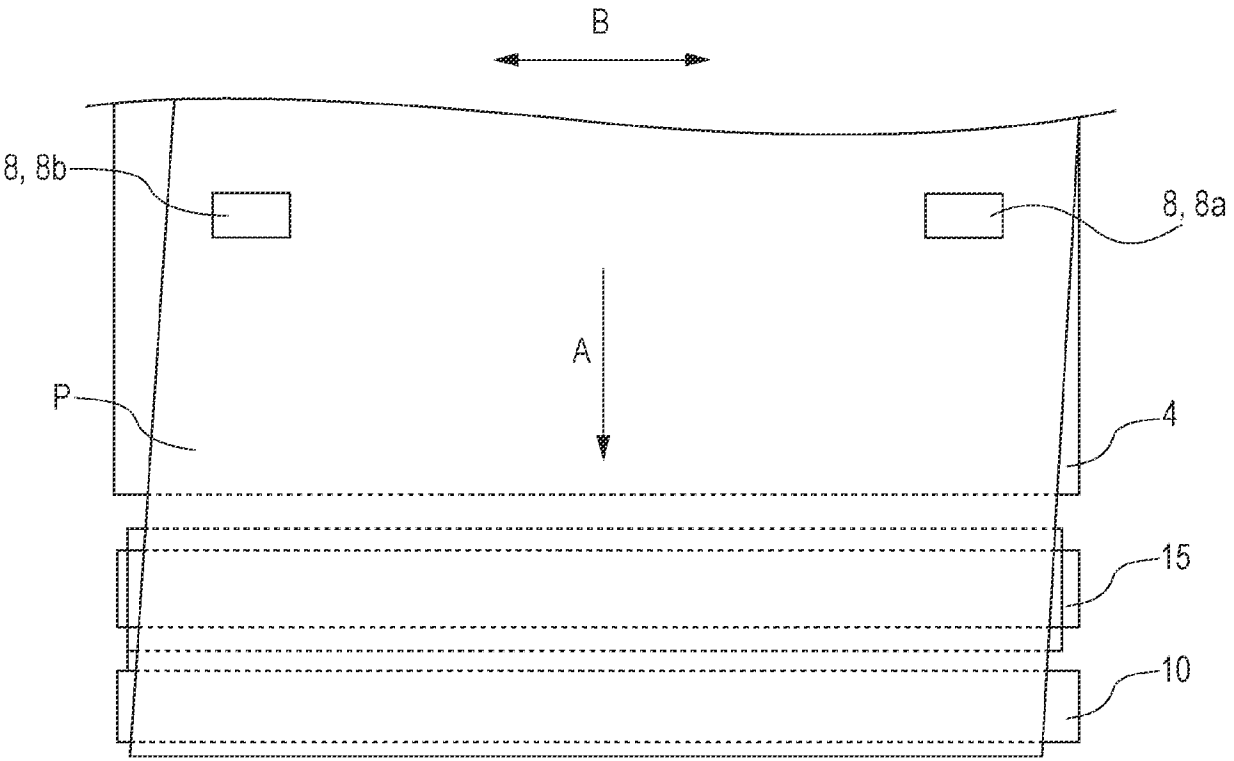
FIG. 4 is a schematic plan view that illustrates a recording apparatus in a skewed transportation state, wherein a transportation target medium experience skew.

Next, the sensor 8 (which may be comprised of a combination of multiple individual sensors, such as sensors 8*a* and 8*b* in FIGS. 3 and 4) of the present embodiment will now be explained in detail. Each of FIGS. 3 and 4 are schematic plan views that illustrate areas around (i.e., regions peripheral to) the sensor 8 in the recording apparatus 1 of the present embodiment. A straight transportation state i.e., a transportation state in which the recording target medium P is not in a skewed state, is illustrated in FIG. 3. A skewed transportation state, i.e., a transportation state in which the recording target medium P is in a skewed state, with positional deviation toward the left (toward sensor 8*b*), is illustrated in FIG. 4, wherein the deviation increases as the recording target medium P moves downstream in the transportation direction A.

As illustrated in FIGS. 3 and 4, the recording apparatus 1 of the present embodiment is provided with a first velocity sensor 8*a* and a second velocity sensor 8*b*. These two velocity sensors constitute the sensor 8 for detecting the velocity of the recording target medium P, which is being transported. When viewed in the transportation direction A, the sensor 8*b* is provided at a position different from that of the sensor 8*a* in the intersecting direction B, which intersects with the transportation direction A. The control unit 18 of the present embodiment operates as an example of a skew detection section. From the velocities detected by the sensors 8*a* and 8*b*, the control unit 18 calculates the velocity difference therebetween. The skewed state of the recording target medium P can be detected on the basis of the velocity difference.

As described above, the difference between velocities detected at different positions in the intersecting direction B as viewed in the transportation direction A of the recording target medium P, for example, detected at a left position and a right position, is calculated, and the skewed state (the degree of skew) of the medium is detected on the basis of the velocity difference. By this means, even if velocity sensors that cannot detect absolute velocities with high precision are used as the first and second velocity sensors 8*a* and 8*b*, it is possible to compensate for the lack of high-precision sensing capability. That is, it is possible to improve the detection precision of the skewed state of the recording target medium P.

The following is a reason why/how the structure described above can compensate for a lack of high-precision sensing capability in cases where velocity sensors that cannot detect absolute velocities with high precision are used. The control unit 18 of the present embodiment calculates the difference between the velocities detected by the sensors 8*a* and 8*b* as follows. In the recording apparatus 1 of the present embodiment, the respective positions of both of the sensors 8*a* and 8*b* in the intersecting direction B can be changed. Therefore, a user can set a distance from the right edge of the recording target medium P to the sensor 8*a* and a distance from the left edge of the recording target medium P to the sensor 8*b* to be equal to each other. The velocity detected by sensor 8*a* may be denoted as V1. The velocity detected by sensor 8*b* may be denoted as V2. When the sensors 8*a* and 8*b* are arranged as described above, the average of the two velocities V1 and V2, i.e. Vave, may be deemed (i.e., designated as) the transportation velocity of the recording target medium P as a whole, where Vave can be expressed as: $Vave=(V1+V2)/2$. The control unit 18 of the present embodiment calculates the value of the velocity difference by computing $((V1-V2)/Vave)\times100(\%)$. Alternatively, the control unit 18 may calculate/compute the value of the velocity difference as (V1−V2) instead of ((V1−V2)/Vave)×100(%).

Since the skewed state of the recording target medium P is judged on the basis of the velocity difference as described above, the structure of the recording apparatus 1 of the present embodiment ensures high-precision detection of the skewed state of the recording target medium P even if velocity sensors that cannot detect absolute velocities with high precision are used. For example, if the skewed state of the recording target medium P is judged on the basis of absolute velocity V1 detected by the sensor 8*a* and absolute velocity V2 detected by the sensor 8*b*, in some cases, it is impossible to detect the skewed state accurately because absolute velocity detection values change depending on the type of the recording target medium P and the like. By contrast in the present embodiment, even if the velocity V1 detected by the sensor 8*a* and the velocity V2 detected by the sensor 8*b* change, the value of ((V1−V2)/Vave)×100(%) does not change because the ratio of the difference of V1 and V2 to Vave does not change. For this reason, it is possible to judge the skewed state accurately. As a matter of course, even if the velocity difference is the same, the transportation state changes depending on the distance of the sensors 8*a* and 8*b*. Therefore, the skewed state is judged on the basis of the distance of the sensors 8*a* and 8*b*.

In skew detection of related art in which the leading edge of a recording target medium P is detected, it is difficult to perform effective detection unless a skew detection sensor is provided at a position where the positional deviation of the recording target medium P caused by a skew on the transportation path of the recording target medium P is large. On the other hand, the recording apparatus 1 of the present embodiment has a so-called roll-to-roll transportation structure, in which a continuous recording target medium P is transported from the set portion 14 to the reeling portion 15. Therefore, the degree of skew in a case of skewed transportation of the recording target medium P tends to be not much different from a certain position to another on the transportation path of the recording target medium P. For this reason, the velocity difference (the degree of skew) tends to be practically the same everywhere on the transportation path of the recording target medium P. This increases design flexibility in determining positions where the first velocity sensor 8*a* and the second velocity sensor 8*b* may be provided/positioned. In addition, the present structure (i.e. mechanism/system/method) for judging the skewed state of the recording target medium P on the basis of a velocity difference is also advantageous when applied to a non-roll-to-roll transportation structure, in which a non-continuous recording target medium P (e.g., an individual sheet of paper) is transported. That is, the present velocity-difference-based judgment makes it possible to detect skewed transportation with high precision even if the sensor 8 is positioned at any location other than a location where the positional deviation of the recording target medium P due to the skewed transportation cumulates (i.e., at a location where the degree of skew is most apparent, such as at a position far from the set portion 14 (or recording head 12) since the degree of skew tends to grow with distance along the transportation direction A). Therefore, flexibility in the position of the sensor 8 is greater than that of a structure in which the skewed state of a recording target medium P cannot be judged with high precision unless a sensor is provided at a position where the positional deviation due to skewed transportation cumulates, or is large. This flexibility is also greater than that of a structure in which the absolute velocity of a recording target medium P is detected to judge the skewed state of a recording target medium, and greater than that of a structure in which the leading edge of a recording target medium P is detected to judge the skewed state thereof. In the present embodiment, the structure of the sensor 8*b* is the same as that of the sensor 8*a*. However, a velocity sensor that has a different structure may be used.

In the straight transportation state illustrated in FIG. 3, there is no difference between the transportation velocity of the recording target medium P detected by the sensor 8*a* and the transportation velocity of the recording target medium P detected by the sensor 8*b*. Therefore, the control unit 18 judges that there is no difference between the velocities detected by the sensors 8*a* and 8*b*. In the skewed transportation state illustrated in FIG. 4, the transportation velocity of the recording target medium P detected by the sensor 8*a* is greater than the transportation velocity of the recording target medium P detected by the sensor 8*b*. Since the transportation velocity of the recording target medium P detected by the sensor 8*a* is greater, the amount of transportation at the sensor 8*a* is larger than the amount of transportation at the sensor 8*b*, and the positional deviation toward the sensor 8*b* increases as the recording target medium P moves downstream in the transportation direction A. Therefore, the control unit 18 judges that there is a difference between the velocities detected by the sensors 8*a* and 8*b* and that it is faster at the sensor 8*a* in the intersecting direction B.

Both of the sensors 8*a* and 8*b* of the present embodiment are configured to emit an electromagnetic wave (light) at (i.e., toward) the recording target medium P, to receive the electromagnetic wave reflected from the recording target medium P, and to calculate the transportation velocity of the recording target medium P from a frequency change due to the Doppler effect. The detection value (the value of absolute velocity) of a velocity sensor that calculates the transportation velocity of a recording target medium P from a frequency change due to the Doppler effect can vary depending on the type of recording target medium P. This is because the state of scattered light reflected from the recording target medium P changes when the type (i.e., material) of the recording target medium P changes. If the detected velocity value of such a velocity sensor is used directly for judging the skewed state of the recording target medium P, it is sometimes difficult to detect the skewed state with high precision because of the effects of the difference in the types of the recording target medium P. In the recording apparatus 1 of the present embodiment, the difference between the velocities detected by the sensors 8*a* and 8*b* is calculated, and the skewed state of the recording target medium P is detected on the basis of the velocity difference. Therefore, it is possible to offset the change in the velocity detected by the sensor 8*a* and the change in the velocity detected by the sensor 8*b* arising from the difference in the types of the recording target medium P. By this means, it is possible to detect the skewed state with high precision irrespective of the type recording target medium. Though it is described above that the sensors 8*a* and 8*b* of the present embodiment emits an electromagnetic wave toward the recording target medium P and receives the electromagnetic wave reflected from the recording target medium P, the sensors may emit a sound wave toward the recording target medium P and receive the sound wave reflected from the recording target medium P.

Preferred examples of a velocity sensor that can calculate the transportation velocity of a recording target medium P from a frequency change due to the Doppler effect will now be explained. A first example of a preferred structure is as follows. Two beams are emitted from the upstream side and the downstream side in the transportation direction A of the recording target medium P. One and the same photoreceptor portion receives light reflected from the recording target medium P (scattered light) in response to the beam emission. The scattered light contains, in the form of a change in optical wavelength, velocity information in the transportation direction A of the recording target medium P. The wavelength of the scattered light coming back as a result of the reflection of the upstream-side emitted light is longer than the emitted light. The wavelength of the scattered light coming back as a result of the reflection of the downstream-side emitted light is shorter than the emitted light. Heterodyne detection is performed to detect the wavelength difference between these two scattered beams. By this means, it is possible to calculate the transportation velocity of the recording target medium P. A second example of a preferred structure is as follows. A beam is emitted from a laser to the recording target medium P moving in the transportation direction A. Scattered light (return light) coming back from the recording target medium P is received at the laser, wherein there is a change in the wavelength of the scattered light due to reflection at the recording target medium P. The output of the laser increases slightly when the return light comes back to the laser if the return light is in phase with the emitted light. This phenomenon of an output increase can be utilized for calculating the transportation velocity of the recording target medium P. The sensors 8*a* and 8*b* according to the present preferred embodiment preferably have the structure of the first example described above.

Figure 5:
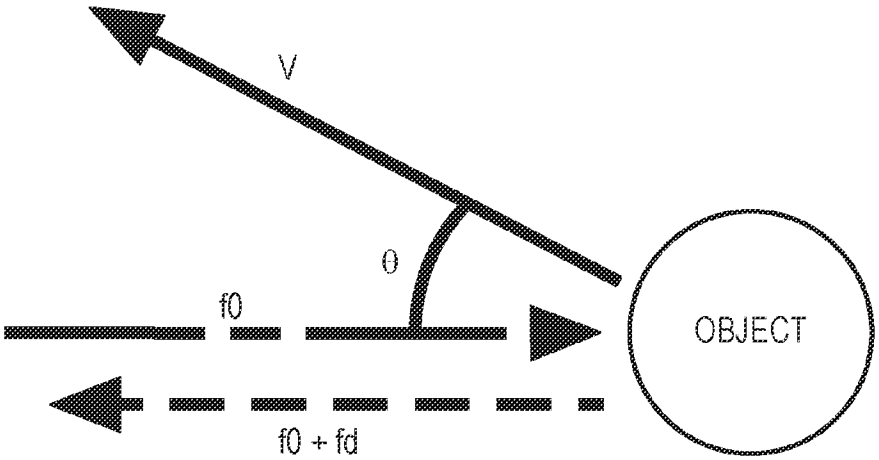
FIG. 5 is a diagram illustrating a relationship between a transportation velocity of a transportation target medium and a Doppler frequency.

With reference to FIG. 5, a general relationship between the transportation velocity V of the recording target medium P and a Doppler frequency fd will now be explained. When emitted light that has a wavelength $\lambda$ and a frequency f0 is applied at an angle of incidence $\theta$ to an object that is moving as a transportation target medium at transportation velocity V, the frequency of reflected light coming back from the object as a result of the reflection of the emitted light having the frequency f0 can be expressed as the sum of the frequency f0 and the Doppler frequency fd, that is, f0+fd. Let Vz be the velocity component of the transportation velocity V in the applied direction of the emitted light. The velocity component can be expressed as: $Vz=V \cos \theta$. The Doppler frequency fd can be expressed as: $fd=2Vz/\lambda$.

In the present embodiment, both of the sensors 8*a* and 8*b* can be moved manually in the intersecting direction B by a user. However, the scope of the invention is not limited to such a structure. Both of the sensors 8*a* and 8*b* may be fixed sensors, which cannot be moved manually in the intersecting direction B. Alternatively, either one, but not both, of the two sensors may be movable in the intersecting direction B. If either one or both of the sensors 8*a* and 8*b* can be moved in the intersecting direction B, adjustment can be made for various widths (size in the intersecting direction B) of the recording target media P. Therefore, such a structure is preferable. A sensor movement mechanism may be provided so that the sensors 8*a* and 8*b* can be moved automatically in the intersecting direction B under the control of the control unit 18, such as to accommodate different sizes of recording target media P. Preferably, each sensor 8*a*, 8*b* should be provided at a position where it will not be outside the area of detection of the recording target medium P even in a case of skewed transportation of the recording target medium P (for example, approximately 2 cm inside the edge of the recording target medium P in the intersecting direction B). However, the longer the distance between the sensors 8*a* and 8*b*, the easier the detection of the velocity difference in a case of skewed transportation of the recording target medium P. Therefore, it is preferred that the sensors 8*a* and 8*b* should be arranged with the longest tolerable distance therebetween in the intersecting direction B.

The recording apparatus 1 of the present embodiment is configured to be able to correct the skewed state of the recording target medium P on the basis of the results of skew detection by the control unit 18. More specifically, if the recording target medium P that is being transported is skewed, the control unit 18 performs control processing for directional adjustment of the recording target medium P in the intersecting direction B by changing either one or both of the attitude (e.g., orientation) and position of at least one of the tension bar 10, the set portion 14, and the reeling portion 15 depending on the degree of the skewed transportation, the direction of the skew, and the like. That is, the control unit 18 functions also as an example of a skew correction execution section that executes skew correction for the recording target medium P. As described above, the control unit 18 detects the skew on the basis of the detection results of the sensors 8*a* and 8*b* and executes skew correction for the recording target medium P on the basis of the skew detection results. Therefore, the recording apparatus 1 of the present embodiment can correct the skewed state of the recording target medium P with high precision.

The operation of transporting the recording target medium P in the transportation direction A and the operation of ejecting ink from the recording head 12 while moving the carriage 11, on which the recording head 12 is mounted, in the intersecting direction B, with the transportation operation stopped, may be repeated alternately under the control of the control unit 18. In this case, the recording apparatus 1 of the present embodiment may perform recording by the alternate repetition of medium transportation and ink ejection. That is, the recording apparatus 1 of the present embodiment preferably forms an image while transporting the recording target medium P intermittently under the control of the control unit 18. The recording apparatus 1 of the present embodiment includes the transportation unit 9, which can transport the recording target medium P intermittently. The control unit 18 can perform skew correction processing on the basis of the tendency of the change in the velocity difference when the recording target medium P is transported intermittently by the transportation unit 9. Therefore, in the recording apparatus 1 of the present embodiment, which includes the transportation unit 9 for transporting the recording target medium P intermittently, the skewed state of the recording target medium P can be corrected with high precision.

An example of skew correction execution based on the tendency of the change in the velocity difference is as follows. The control unit 18 calculates the cumulative value of the velocity difference when the recording target medium P is transported intermittently, and compares the cumulative value with a first threshold. If the cumulative value is in excess of the first threshold, the control unit 18 controls at least one of the tension bar 10, the set portion 14, and the reeling portion 15 to correct the skew (i.e., for the execution of skew correction). When the recording target medium P is transported, in some cases, there is continuous positional deviation toward one side in the intersecting direction B. In other cases, positional deviation toward one side in the intersecting direction B and positional deviation toward the other side in the intersecting direction B alternate. In the execution example described above, the control unit 18 calculates the cumulative value of the velocity difference when the recording target medium P is transported, which may happen intermittently, and compares the cumulative value with the first threshold. By this means, in the event that the degree of skew reaches a degree that necessitates skew correction, it is possible to appropriately detect the event and execute skew correction.

Figure 6:
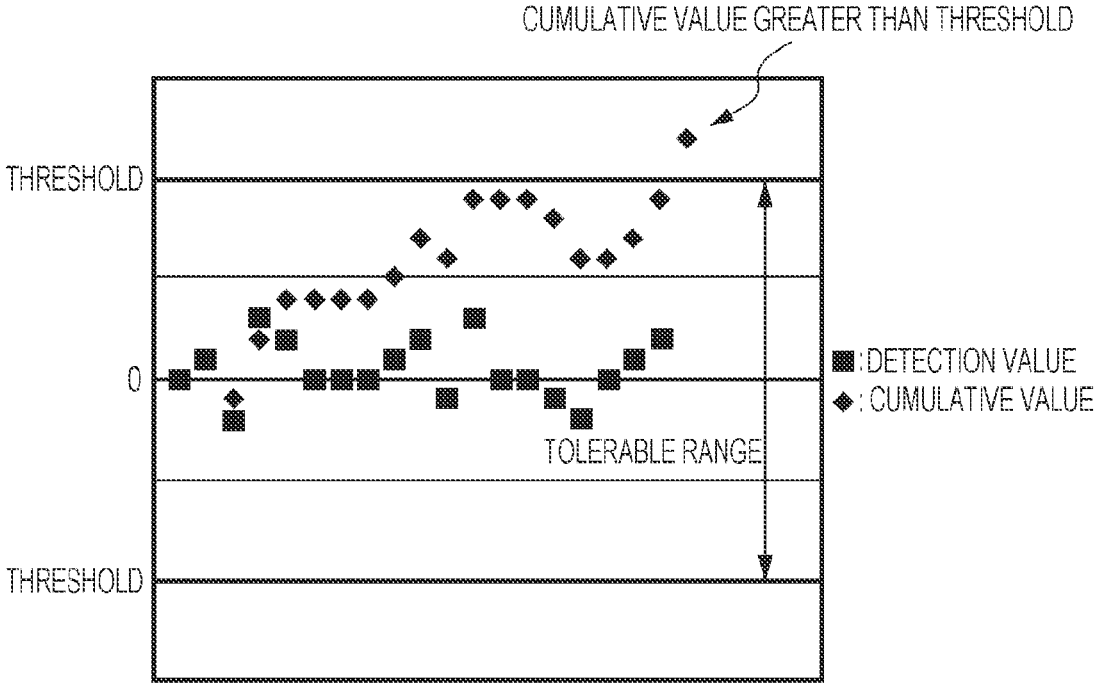
FIG. 6 is a graph illustrating an example of both individual and cumulative skew detection for purposes of determining when to apply skew correction in a case where target medium transportation is intermittent.

The timing of skew correction execution of the recording apparatus 1 of the present embodiment will now be explained with reference to FIG. 6, which is a graph of a specific example thereof. In the recording apparatus 1 of the present embodiment, the cumulative value of the velocity difference is calculated at each time of transportation operation when the recording target medium P is transported intermittently. In the graph, each filled square denotes the detection value of the velocity difference at the time of transportation operation when the recording target medium P is transported intermittently, and each filled rhombus denotes the cumulative value thereof. A case where there is no velocity difference corresponds to 0 in the direction of the vertical axis of the graph. Although not shown in the figures, a case of skewed transportation of the recording target medium P toward the sensor 8*a* (a case where it is faster at the sensor 8*b* than the sensor 8*a*) corresponds to the positive region (above 0) in the direction of the vertical axis of the graph. A case of skewed transportation of the recording target medium P toward the sensor 8*b*, as illustrated in FIG. 4, (a case where it is faster at the sensor 8*a* than the sensor 8*b*) corresponds to the negative region (below 0) in the direction of the vertical axis of the graph. If the cumulative value exceeds the upper or lower threshold (first threshold), skew correction is executed in accordance with the direction of the skewed transportation.

The control unit 18 compares the velocity difference with a second threshold at each time of transportation operation when the recording target medium P is transported intermittently, and can notify error information by outputting alarm sound or performing error information display on the PC 29 if the velocity difference is in excess of the second threshold. The error notification is desirable because skew correction may not work fully during one transportation operation in a case of a large skew because the transportation amount in one transportation operation may be small. By comparing the individual (not the cumulative) velocity difference with the second threshold at each time of transportation operation when the recording target medium P is transported intermittently, it is possible to notify error information and thereby prevent the problem from spreading. The second threshold, with which the velocity difference is compared, may be the same as the first threshold, with which the cumulative value of the velocity difference is compared. Alternatively, the second threshold may be different from the first threshold.

The recording apparatus may include a transportation unit 9 that can transport the recording target medium P non-intermittently, for example, as in a recording apparatus equipped with a line-head recording unit, and the control unit 18 operating as an example of the skew detection section may perform skew correction processing on the basis of the tendency of the change in the velocity difference when the recording target medium P is transported non-intermittently. With this structure, it is possible to correct the skewed state of the recording target medium P with high precision in the recording apparatus 1 configured to transport the recording target medium P non-intermittently.

The following is an example of skew correction execution based on the tendency of the change in the velocity difference in the recording apparatus 1 that has this structure. The control unit 18 calculates the cumulative value of the velocity difference when the recording target medium P is transported continuously (i.e., non-intermittently), and compares the cumulative value with a third threshold. If the cumulative value is in excess of the third threshold, skew correction is executed. When the recording target medium P is transported, in some cases, there is continuous positional deviation toward one side in the intersecting direction B. In other cases, positional deviation toward one side in the intersecting direction B and positional deviation toward the other side in the intersecting direction B alternate. In the execution example described above, the control unit 18 calculates the cumulative value of the velocity difference when the recording target medium P is transported non-intermittently, and compares the cumulative value with the third threshold. By this means, in the event that the degree of skew reaches a degree that necessitates skew correction, it is possible to appropriately detect the event and execute skew correction.

Figure 7:
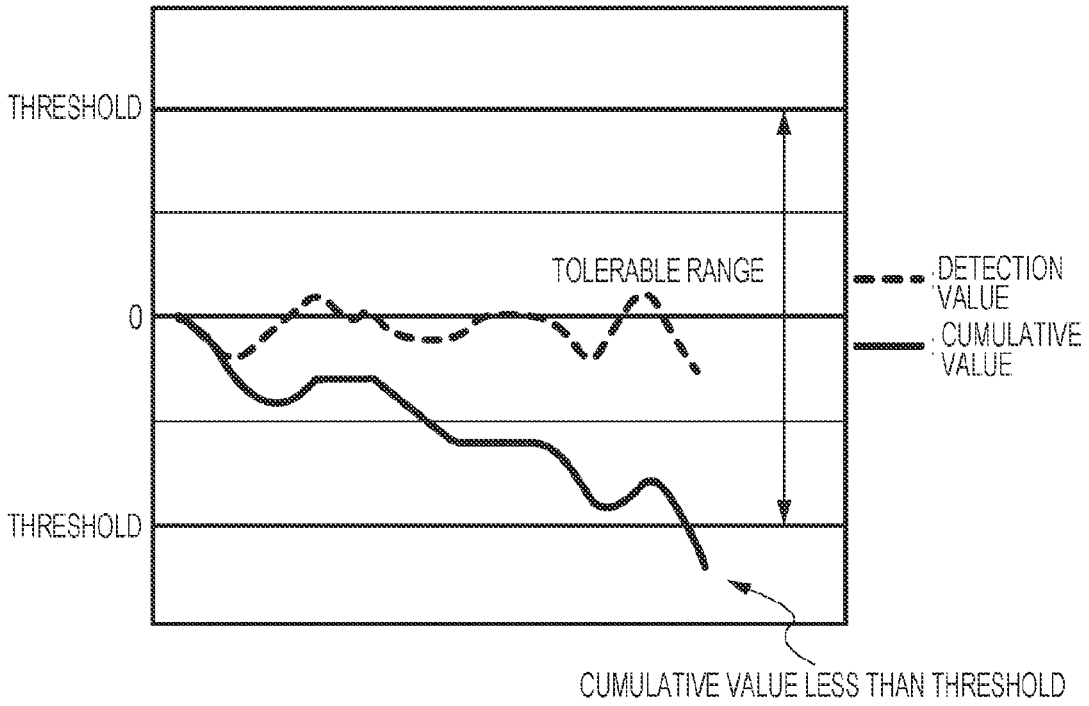
FIG. 7 is a graph illustrating an example of both individual and cumulative skew detection for purposes of determining when to apply skew correction in a case where target medium transportation is continuous.

The timing of skew correction execution of the recording apparatus 1 that can transport the recording target medium P non-intermittently will now be explained with reference to FIG. 7, which is a graph of a specific example thereof. In the recording apparatus 1, the cumulative value of the velocity difference is calculated when the recording target medium P is transported non-intermittently. In the graph, the broken-line curve represents the detection values of the velocity difference when the recording target medium P is transported non-intermittently, and the solid-line curve represents the cumulative values thereof. A case where there is no velocity difference corresponds to 0 in the direction of the vertical axis of the graph. A case of skewed transportation of the recording target medium P toward one side in the intersecting direction B (a case where it is faster at one side than the other side) corresponds to the positive region (above 0) in the direction of the vertical axis of the graph. A case of skewed transportation of the recording target medium P toward the other side in the intersecting direction B (a case where it is faster at the other, opposite side) corresponds to the negative region (below 0) in the direction of the vertical axis of the graph. If the cumulative value exceeds the upper or lower threshold (third threshold), skew correction is executed in accordance with the direction of the skewed transportation.

The following is an example of skew correction execution based on the tendency of the change in the velocity difference in the recording apparatus 1 that has this structure. The control unit 18 compares each individual (not cumulative) observed velocity difference with a fourth threshold when the recording target medium P is transported non-intermittently, and can notify error information by outputting an alarm sound or performing an error information display on the PC 29 if the individual velocity difference is in excess of the fourth threshold. The error notification is desirable because skew correction does not work fully in a case of a large skew for a small transportation amount. By comparing an individual velocity difference with the fourth threshold when the recording target medium P is transported non-intermittently, it is possible to notify error information and thereby prevent a problem from spreading. The fourth threshold, with which the velocity difference is compared, may be the same as the third threshold, with which the cumulative value of the velocity difference is compared. Alternatively, the fourth threshold may be different from the third threshold.

Second Embodiment

Figure 8:
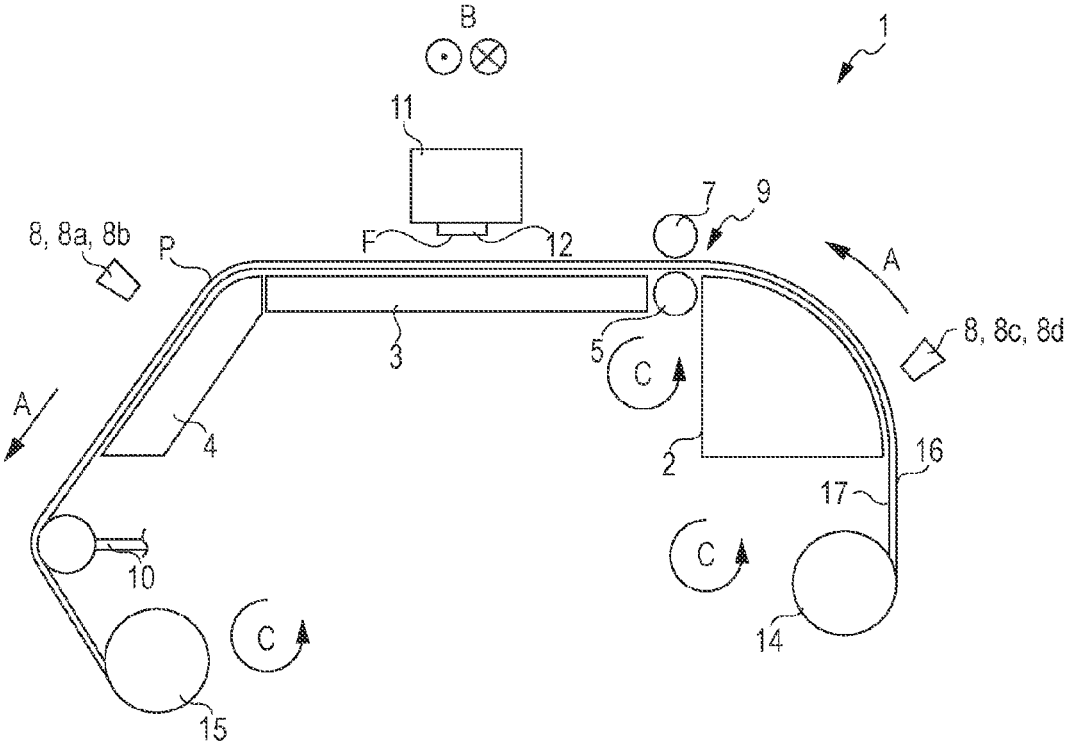
FIG. 8 is a schematic side view that illustrates a recording apparatus according to an alternate embodiment of the invention.

Next, with reference to the accompanying drawings, a recording apparatus according to a second embodiment will now be explained in detail. FIG. 8 is a schematic side view that illustrates the recording apparatus 1 of the present embodiment. FIG. 8 corresponds to FIG. 1, which illustrates the recording apparatus 1 of the first embodiment. The same reference numerals are assigned to the same components as those of the first embodiment. A detailed explanation of them is not given here. The structure of the recording apparatus 1 of the present embodiment is the same as that of the recording apparatus 1 of the first embodiment except that the sensor 8 for detecting the transportation velocity of the recording target medium P includes sensors 8*c* and 8*d* in addition to the sensors 8*a* and 8*b*.

In the recording apparatus 1 of the first embodiment, the sensor 8 is provided downstream of the recording head 12 and upstream of the reeling portion 15 in the transportation direction A. Therefore, it is possible to detect skewed transportation before reeling by the reeling portion 15. By this means, it is possible to effectively prevent poor reeling at the reeling portion 15. The recording apparatus 1 of the first embodiment has a so-called roll-to-roll transportation structure, in which a continuous recording target medium P is transported from the set portion 14 to the reeling portion 15. Therefore, the degree of skew in a case of skewed transportation of the recording target medium P tends to be not much different from a certain position to another on the transportation path of the recording target medium P. However, since the recording apparatus 1 of the first embodiment has a structure of pinching the recording target medium P at the transportation unit 9, there is a possibility that the skewed state before the pinching, that is, from the set portion 14 to the transportation unit 9, might be slightly different from the skewed state after the pinching, that is, from the transportation unit 9 to the reeling portion 15.

In addition to the sensors 8*a* and 8*b*, which are provided downstream of the recording head 12 and upstream of the reeling portion 15 in the transportation direction A, the recording apparatus 1 of the present embodiment is provided with sensors 8*c* and 8*d*, which are provided downstream of the set portion 14 and upstream of the recording head 12 in the transportation direction A. Because of this structure, even in a case where the skewed state from the set portion 14 to the transportation unit 9 is different from the skewed state from the transportation unit 9 to the reeling portion 15, it is possible to detect the skewed state at both effectively and suppress the skewed state at both effectively. The sensor 8*c* of the present embodiment is a first velocity sensor that detects the transportation velocity of the recording target medium P. The sensor 8*d* of the present embodiment is a second velocity sensor that detects the transportation velocity of the recording target medium P and is provided at a position different from that of the sensor 8*c* in the intersecting direction B as viewed in the transportation direction A. The structure of the sensors 8*c* and 8*d* is preferably the same (or similar) as that of the sensors 8*a* and 8*b*. If desired, the recording apparatus 1 may be provided with the sensors 8*c* and 8*d* only, without the sensors 8*a* and 8*b*.

Third Embodiment

Figure 9:
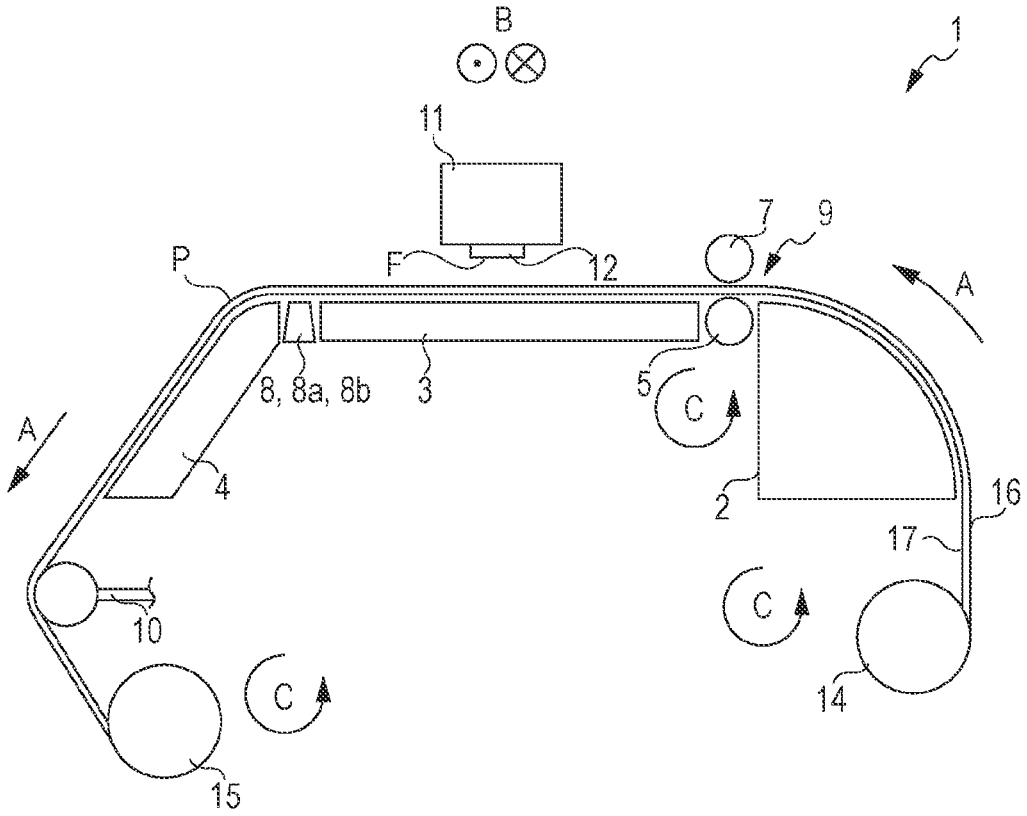
FIG. 9 is a schematic side view that illustrates a recording apparatus according to another embodiment of the invention.

Next, with reference to the accompanying drawings, a recording apparatus according to a third embodiment will now be explained in detail. FIG. 9 is a schematic side view that illustrates the recording apparatus 1 of the present embodiment. FIG. 9 corresponds to FIG. 1, which illustrates the recording apparatus 1 of the first embodiment. The same reference numerals are assigned to the same components as those of the first and second embodiments. A detailed explanation of them is not given here. The structure of the recording apparatus 1 of the present embodiment is the same as that of the recording apparatus 1 of the first embodiment except for the arrangement of the sensors 8*a* and 8*b*.

The sensor 8*a*, 8*b* of the first embodiment is configured to emit an electromagnetic wave toward the recording surface 16 of the recording target medium P, to receive the electromagnetic wave reflected from the recording surface 16 of the recording target medium P, and to calculate the transportation velocity of the recording target medium P from a frequency change due to the Doppler effect. In contrast, the sensor 8*a*, 8*b* of the present embodiment is configured to emit an electromagnetic wave toward the reverse surface 17, which is the opposite side of the recording surface 16 of the recording target medium P, to receive the electromagnetic wave reflected from the reverse surface 17 (i.e., the non-recording surface) of the recording target medium P, and to calculate the transportation velocity of the recording target medium P from a frequency change due to the Doppler effect.

To put it another way, the recording apparatus 1 of the present embodiment is equipped with the recording unit 12, which can perform recording on the recording target medium P, and the sensor 8*a*, 8*b* of the present embodiment emits an electromagnetic wave to the recording target medium P, receives the electromagnetic wave reflected from the recording target medium P, and calculates the transportation velocity of the recording target medium P from a frequency change due to the Doppler effect, wherein the sensors 8*a* and 8*b* are provided at the reverse-surface side so as to be able to emit the electromagnetic wave to the reverse surface 17, which is the opposite of the recording surface 16 of the recording target medium P. Because of this structure, it is possible to detect the skewed state with high precision without damaging the recording surface 16 by the electromagnetic wave, and perform damage-free recording. As a substitute for the sensor 8*a*, 8*b* of the present embodiment, a velocity sensor that emits a sound wave to the reverse surface 17, which is the opposite of the recording surface 16 of the recording target medium P, and receives the sound wave reflected from the reverse surface 17 of the recording target medium P may be used.

Fourth Embodiment

Figure 10:
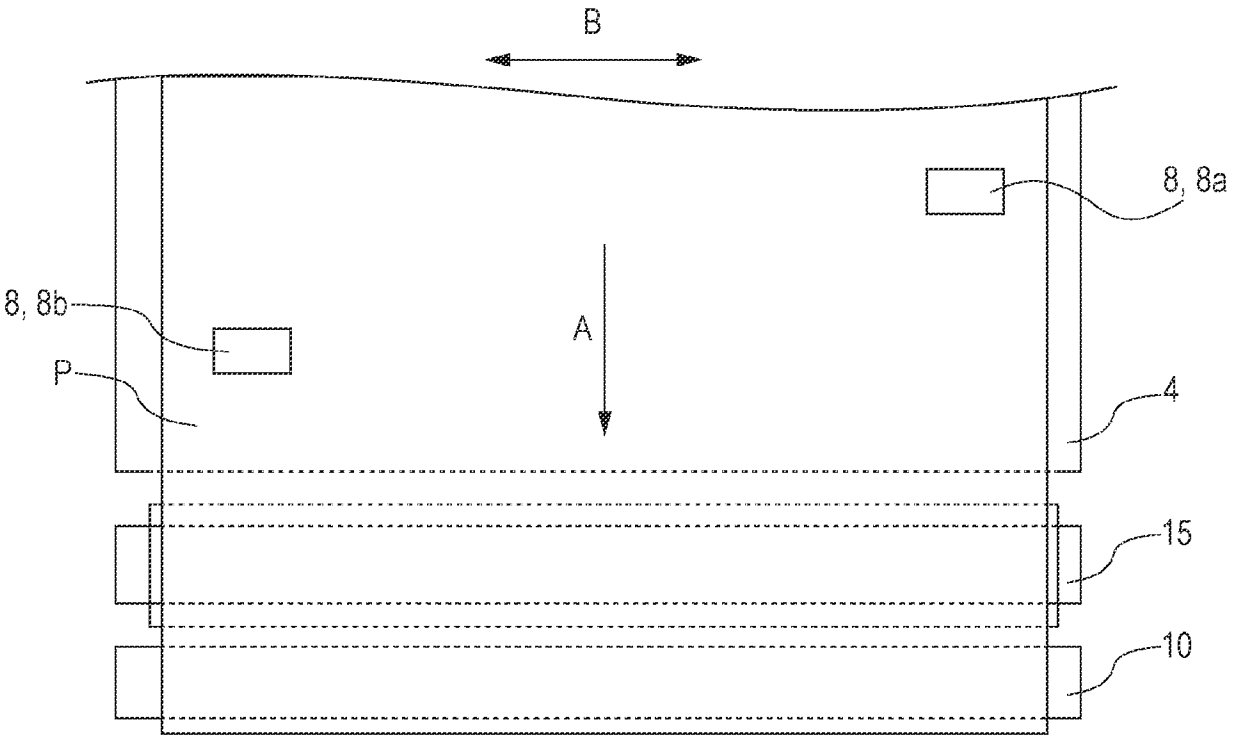
FIG. 10 is a schematic plan view that illustrates an alternate positioning of velocity sensors.

Next, with reference to the accompanying drawings, a recording apparatus according to a fourth embodiment will now be explained in detail. FIG. 10 is a schematic plan view that illustrates a feature of the recording apparatus 1 of the present embodiment. FIG. 10 corresponds to FIG. 3 of the recording apparatus 1 of the first embodiment. The same reference numerals are assigned to the same components as those of the first, second, and third embodiments. A detailed explanation of them is not given here. The structure of the recording apparatus 1 of the present embodiment is the same as that of the recording apparatus 1 of the first embodiment except for the arrangement of the sensors 8*a* and 8*b*.

Sensors 8*a* and 8*b* of the present embodiment are arranged out of alignment with each other as viewed in the intersecting direction B, with a positional shift from each other in the transportation direction A (arranged obliquely in a plan view). As described above, the sensors 8*a* and 8*b* may be arranged obliquely in a plan view. In the present embodiment, the sensor 8*a* is provided upstream of the sensor 8*b* in the transportation direction A. By contrast in the first embodiment of FIG. 3, the sensor 8*a* is provided downstream of the sensor 8*b* in the transportation direction A.

Fifth Embodiment

Figure 11:
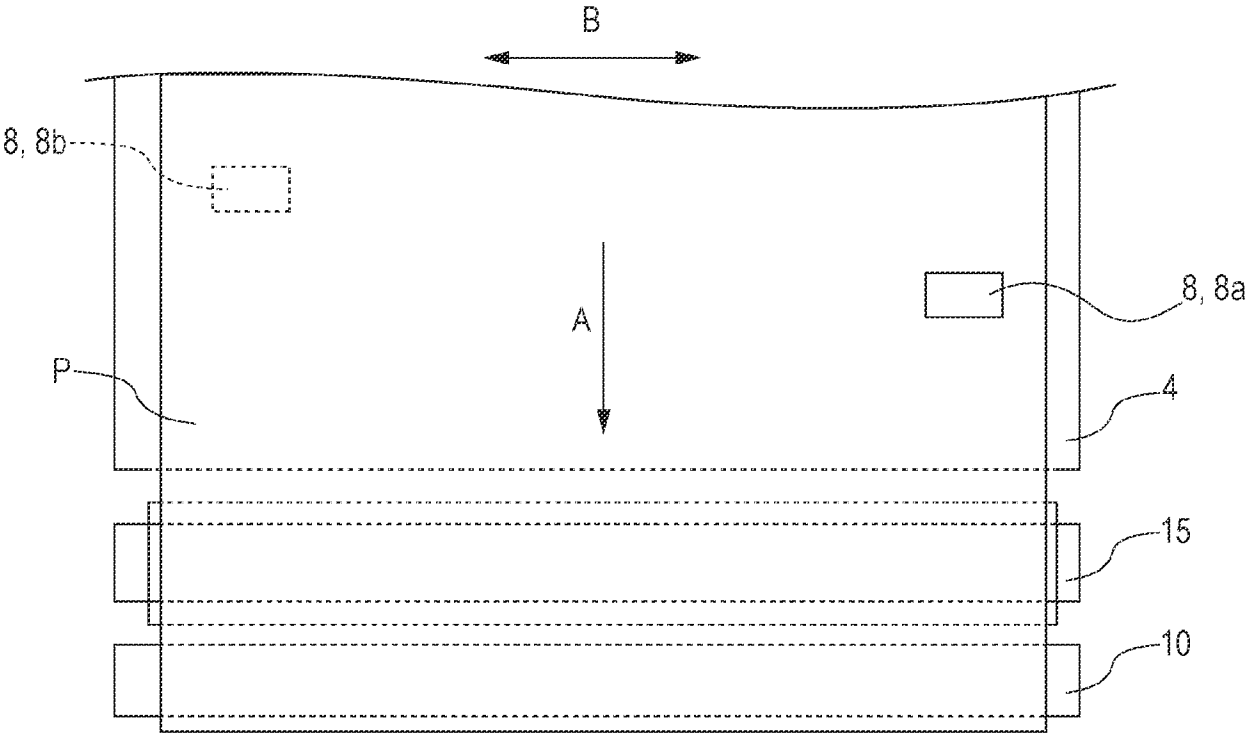
FIG. 11 is a schematic plan view that illustrates another alternate positioning of velocity sensors.

Next, with reference to the accompanying drawings, a recording apparatus according to a fifth embodiment will now be explained in detail. FIG. 11 is a schematic plan view that illustrates an essential part of the recording apparatus 1 of the present embodiment. FIG. 11 corresponds to FIG. 3 of the recording apparatus 1 of the first embodiment. The same reference numerals are assigned to the same components as those of the first to fourth embodiments. A detailed explanation of them is not given here. The structure of the recording apparatus 1 of the present embodiment is the same as that of the recording apparatus 1 of the first embodiment except for the arrangement of the sensors 8*a* and 8*b*.

Both sensors 8*a* and 8*b* of the first embodiment are provided at the recording-surface side to face the recording surface 16 of the recording target medium P. In the present embodiment, the sensors 8*a* and 8*b* of the present embodiment are arranged out of alignment with each other as viewed in the intersecting direction B, with a positional shift from each other in the transportation direction A (arranged obliquely in a plan view). Additionally in the present embodiment, the sensor 8*a* is provided at the recording-surface side to face the recording surface 16 of the recording target medium P, and the sensor 8*b* is provided at the reverse-surface side to face the reverse surface 17, which is the opposite of the recording surface 16 of the recording target medium P. As described above, the sensors 8*a* and 8*b* may be arranged obliquely in a plan view, and, in addition, one of these two sensors may be provided at the recording-surface side to face the recording surface 16 of the recording target medium P, and the other may be provided at the reverse-surface side to face the (non-recording) reverse surface 17, which is the opposite of the recording surface 16 of the recording target medium P. In the present embodiment, the sensor 8*a* is provided downstream of the sensor 8*b* in the transportation direction A. However, the sensor 8*a* may be provided upstream of the sensor 8*b* in the transportation direction A. In the present embodiment, the sensor 8*a* is provided at the recording-surface side to face the recording surface 16 of the recording target medium P, and the sensor 8*b* is provided at the reverse-surface side to face the reverse surface 17 of the recording target medium P. However, the sensor 8*a* may be provided at the reverse-surface side to face the reverse surface 17 of the recording target medium P, and the sensor 8*b* may be provided at the recording-surface side to face the recording surface 16 of the recording target medium P.

The scope of the invention is not limited to the foregoing embodiments. The invention may be modified, altered, changed, adapted, and/or improved within the scope of the recitation of appended claims. Needless to say, an apparatus subjected to such a modification, alteration, change, adaptation, and/or improvement is also within the scope of the invention. Needless to say, the apparatus to which the invention can be applied is not limited to a recording apparatus; the invention can be applied to various apparatuses, for example, a liquid crystal film manufacturing apparatus or a metal draw roll transportation apparatus. The following is a summary of the exemplary embodiments of the invention explained in detail above.

A transportation apparatus 1 according to a first mode of the invention comprises: a first velocity sensor 8*a* (8*c*) that detects transportation velocity of a transportation target medium P, which is a medium that is transported; a second velocity sensor 8*b* (8*d*) that detects transportation velocity of the medium P and is provided at a position different from that of the first velocity sensor 8*a* (8*c*) in an intersecting direction B as viewed in a transportation direction A of the medium P, the intersecting direction B intersecting with the transportation direction A; and a skew detection section 18 that calculates a velocity difference from the velocities detected by the first and second velocity sensors 8*a* (8*c*) and 8*b* (8*d*), and detects a skewed state of the medium P on the basis of the velocity difference.

In this aspect, the difference between velocities detected at different positions in the intersecting direction B as viewed in the transportation direction A of the medium P, for example, detected at a left position and a right position, is calculated, and the skewed state, that is, the degree of skew of the medium P, is detected on the basis of the velocity difference. By this means, even if velocity sensors that cannot detect absolute velocities with high precision are used as the first velocity sensor 8*a* (8*c*) and the second velocity sensor 8*b* (8*d*), it is possible to compensate for the lack of high-precision sensing capability. That is, it is possible to improve the detection precision of the skewed state of the medium P. In skew detection of related art in which the leading edge of a medium P is detected, it is difficult to perform effective detection unless a skew detection sensor is provided at a position where the positional deviation of the medium P caused by a skew on the transportation path of the medium P is large. On the other hand, the transportation apparatus of this aspect can be applied to a so-called roll-to-roll transportation structure for transporting a continuous medium P. When applied to such a structure, the degree of skew in a case of skewed transportation of the medium P tends to be not much different from a certain position to another on the transportation path of the medium P. For this reason, it is possible to ensure that the velocity difference (the degree of skew) tends to be practically the same everywhere on the transportation path of the medium P. This increases design flexibility in determining positions where the first velocity sensor 8*a* (8*c*) and the second velocity sensor 8*b* (8*d*) are provided.

In a transportation apparatus 1 according to a second mode of the invention, which is a preferred mode, in the first mode, the first velocity sensor 8*a* (8*c*) and the second velocity sensor 8*b* (8*d*) are configured to emit an electromagnetic wave or a sound wave to the medium P, to receive the electromagnetic wave or the sound wave reflected from the medium P, and to calculate the transportation velocity of the medium P from a frequency change due to a Doppler effect.

The detected velocity value of a velocity sensor 8 that calculates the transportation velocity of a medium P from a frequency change due to the Doppler effect can vary depending on the type of the medium P. If the detected velocity value of such a velocity sensor is used directly for judging the skewed state of the medium P, it is sometimes difficult to detect the skewed state with high precision because of the effects of the difference in the type of the medium P. In this preferred mode, the difference between the velocities detected by the first velocity sensor 8*a* (8*c*) and the second velocity sensor 8*b* (8*d*) is calculated, and the skewed state of the medium P is detected on the basis of the velocity difference. Therefore, it is possible to offset the change in the velocity detected by the first velocity sensor 8*a* (8*c*) and the change in the velocity detected by the second velocity sensor

8*b* (8*d*) arising from the difference in the type of the medium P. By this means, it is possible to detect the skewed state with high precision.

In the first or second mode, a transportation apparatus 1 according to a third mode of the invention, which is a preferred mode, further comprises: a skew correction execution section 18 that executes skew correction for the medium P on the basis of detection results of the skew detection section 18.

In this preferred mode, skew correction is executed for the medium P on the basis of detection results of the skew detection section 18. Therefore, it is possible to correct the skewed state of the medium P with high precision.

In the third mode, a transportation apparatus 1 according to a fourth mode of the invention, which is a preferred mode, further comprises: a transportation unit 9 that can transport the medium P intermittently, wherein the skew correction execution section 18 executes the skew correction on the basis of a tendency of a change in the velocity difference when the medium P is transported intermittently by the transportation unit 9.

In this preferred mode, the transportation apparatus 1 further comprises: a transportation unit 9 that can transport the medium P intermittently, wherein the skew correction execution section 18 executes the skew correction on the basis of a tendency of a change in the velocity difference when the medium P is transported intermittently by the transportation unit 9. Therefore, in the transportation apparatus 1 equipped with the transportation unit 9 for transporting the medium P intermittently, the skewed state of the medium P can be corrected with high precision.

In a transportation apparatus 1 according to a fifth mode of the invention, which is a preferred mode, in the fourth mode, the skew correction execution section 18 calculates a cumulative value of the velocity difference when the medium P is transported intermittently by the transportation unit 9, compares the cumulative value with a first threshold, and executes the skew correction if the cumulative value is in excess of the first threshold.

With this preferred mode, in the transportation apparatus 1 equipped with the transportation unit 9 for transporting the medium P intermittently, in the event that the degree of skew reaches a degree that necessitates skew correction, it is possible to appropriately detect the event by calculating the cumulative value of the velocity difference when the recording target medium P is transported intermittently and by comparing the cumulative value with the first threshold, and execute skew correction.

In any of the first to fifth modes, a transportation apparatus 1 according to a sixth mode of the invention, which is a preferred mode, further comprises: a transportation unit 9 that can transport the medium P intermittently, wherein the velocity difference is compared with a second threshold at each time of transportation operation when the medium P is transported intermittently by the transportation unit 9; and wherein error information is notified if the velocity difference is in excess of the second threshold.

With this preferred mode, in the transportation apparatus 1 equipped with the transportation unit 9 for transporting the medium P intermittently, it is possible to notify error information and thereby prevent the problem from spreading by comparing the velocity difference with the second threshold at each time of transportation operation when the medium P is transported intermittently. The second threshold, with which the velocity difference is compared, may be the same as the first threshold, with which the cumulative value of the velocity difference is compared. The second threshold may be different from the first threshold.

In the third mode, a transportation apparatus 1 according to a seventh mode of the invention, which is a preferred mode, further comprises: a transportation unit 9 that can transport the medium P non-intermittently, wherein the skew correction execution section 18 executes the skew correction on the basis of a tendency of a change in the velocity difference when the medium P is transported non-intermittently by the transportation unit 9.

In this preferred mode, the transportation apparatus 1 further comprises: a transportation unit 9 that can transport the medium P non-intermittently, wherein the skew correction execution section 18 executes the skew correction on the basis of a tendency of a change in the velocity difference when the medium P is transported non-intermittently by the transportation unit 9. Therefore, in the transportation apparatus equipped with the transportation unit 9 for transporting the medium P non-intermittently, the skewed state of the medium P can be corrected with high precision.

In a transportation apparatus 1 according to an eighth mode of the invention, which is a preferred mode, in the seventh mode, the skew correction execution section 18 calculates a cumulative value of the velocity difference when the medium P is transported non-intermittently by the transportation unit 9, compares the cumulative value with a third threshold, and executes the skew correction if the cumulative value is in excess of the third threshold.

With this preferred mode, in the transportation apparatus 1 equipped with the transportation unit 9 for transporting the medium P non-intermittently, in the event that the degree of skew reaches a degree that necessitates skew correction, it is possible to appropriately detect the event by calculating the cumulative value of the velocity difference when the recording target medium P is transported non-intermittently by the transportation unit 9 and by comparing the cumulative value with the third threshold, and execute skew correction.

In any of the first to eighth modes, a transportation apparatus 1 according to a ninth mode of the invention, which is a preferred mode, further comprises: a transportation unit 9 that can transport the medium P non-intermittently, wherein the velocity difference is compared with a fourth threshold when the medium P is transported non-intermittently by the transportation unit 9; and wherein error information is notified if the velocity difference is in excess of the fourth threshold.

With this preferred mode, in the transportation apparatus 1 equipped with the transportation unit 9 for transporting the medium P non-intermittently, it is possible to notify error information and thereby prevent the problem from spreading by comparing the velocity difference with the fourth threshold when the medium P is transported non-intermittently by the transportation unit 9. The fourth threshold, with which the velocity difference is compared, may be the same as the third threshold, with which the cumulative value of the velocity difference is compared. The fourth threshold may be different from the third threshold.

A recording apparatus 1 according to a tenth mode of the invention comprises: the transportation apparatus 1 according to any of the first to ninth modes; and a recording unit 12 that can perform recording on a recording target medium P that is transported as the medium P.

With this aspect, it is possible to detect the skewed state with high precision, and perform recording.

A recording apparatus 1 according to an eleventh mode of the invention comprises: the transportation apparatus 1 according to the second mode; and a recording unit 12 that can perform recording on a recording target medium P that is transported as the medium P, wherein the first velocity sensor 8*a* (8*c*) and the second velocity sensor 8*b* (8*d*) are provided in such a way as to be able to emit the electromagnetic wave or the sound wave to a reverse surface 17 that is the opposite of a recording surface 16 of the recording target medium P.

In this aspect, the first velocity sensor 8*a* (8*c*) and the second velocity sensor 8*b* (8*d*) are provided in such a way as to be able to emit the electromagnetic wave or the sound wave to a reverse surface 17 that is the opposite of a recording surface 16 of the recording target medium P. Because of this structure, it is possible to detect the skewed state with high precision without damaging the recording surface 16 by the electromagnetic wave or the sound wave, and perform damage-free recording.

What is claimed is:

1. A transportation apparatus, comprising:

a first velocity sensor located at a first position to detect a first transportation velocity of a medium as it is transported in a transportation direction;

a second velocity sensor to detect a second transportation velocity of the medium as it is transported in the transportation direction, said second velocity sensor being located at a second position offset from the first position in a spanning direction intersecting the transportation direction;

a skew detection section that calculates a velocity difference between the first transportation velocity and the second transportation velocity, and detects a skew state of the medium on the basis of the velocity difference;

a skew correction execution section that executes skew correction for the medium on the basis of the skew state detected by the skew detection section; and a transportation section that transports the medium intermittently;

wherein the skew correction execution section executes the skew correction on the basis of a tendency of a change in the velocity difference when the medium is transported by the transportation section.

2. The transportation apparatus according to claim 1, wherein the skew correction execution section calculates a cumulative value of the velocity difference each time new velocity difference is calculated, compares the cumulative value with a first threshold, and executes the skew correction if the magnitude of the cumulative value is not less than the magnitude of the first threshold.

3. A recording apparatus, comprising:

the transportation apparatus of claim 2; and a recording section that records on the medium.

4. A recording apparatus, comprising:

the transportation apparatus of claim 1; and a recording section that records on the medium.

5. A transportation apparatus, comprising:

a first velocity sensor located at a first position to detect a first transportation velocity of a medium as it is transported in a transportation direction;

a second velocity sensor to detect a second transportation velocity of the medium as it is transported in the transportation direction, said second velocity sensor being located at a second position offset from the first position in a spanning direction intersecting the transportation direction;

a skew detection section that calculates a velocity difference between the first transportation velocity and the second transportation velocity, and detects a skew state of the medium on the basis of the velocity difference; and a transportation section that transports the medium intermittently;

wherein:

the skew detection section calculates a new one of said velocity difference each time the transportation section transports the medium;

the skew detection section compares each new one of said velocity difference with a second threshold; and wherein error information is issued in response to a magnitude of a new one of said velocity difference exceeding a magnitude of the second threshold.

6. A recording apparatus, comprising:

the transportation apparatus of claim 5; and a recording section that records on the medium.

7. A transportation apparatus, comprising:

a first velocity sensor located at a first position to detect a first transportation velocity of a medium as it is transported in a transportation direction;

a second velocity sensor to detect a second transportation velocity of the medium as it is transported in the transportation direction, said second velocity sensor being located at a second position offset from the first position in a spanning direction intersecting the transportation direction;

a skew detection section that calculates a velocity difference between the first transportation velocity and the second transportation velocity, and detects a skew state of the medium on the basis of the velocity difference;

a skew correction execution section that executes skew correction for the medium on the basis of the skew state detected by the skew detection section; and a transportation section that transports the medium in a non-intermittent manner;

wherein the skew correction execution section executes the skew correction on the basis of a tendency of a change in the velocity difference when the medium is transported non-intermittently by the transportation section.

8. The transportation apparatus according to claim 7, wherein the skew correction execution section calculates a cumulative value of the velocity difference when the medium is transported non-intermittently by the transportation section, compares the cumulative value with a third threshold, and executes the skew correction if the cumulative value is in excess of the third threshold.

9. A recording apparatus, comprising:

the transportation apparatus of claim 8; and a recording section that records on the medium.

10. A recording apparatus, comprising:

the transportation apparatus of claim 7; and a recording section that records on the medium.

11. A transportation apparatus, comprising:

a first velocity sensor located at a first position to detect a first transportation velocity of a medium as it is transported in a transportation direction;

a second velocity sensor to detect a second transportation velocity of the medium as it is transported in the transportation direction, said second velocity sensor being located at a second position offset from the first position in a spanning direction intersecting the transportation direction;

a skew detection section that calculates a velocity difference between the first transportation velocity and the second transportation velocity, and detects a skew state of the medium on the basis of the velocity difference; and a transportation section that transports the medium non-intermittently;

wherein the velocity difference is compared with a fourth threshold when the medium is transported non-intermittently by the transportation section; and wherein error information is issued in response to the velocity difference being in excess of the fourth threshold.

12. A recording apparatus, comprising:

the transportation apparatus of claim 11; and a recording section that records on the medium.

* * * * *